United States Patent [19]

Valesko

[11] Patent Number: 4,469,300

[45] Date of Patent: Sep. 4, 1984

[54] WIRE BAG STAND FOR HOLDING PLASTIC BAG

[75] Inventor: Thomas M. Valesko, Seneca Castle, N.Y.

[73] Assignee: Valerco Corporation, Seneca Castle, N.Y.

[21] Appl. No.: 390,051

[22] Filed: Jun. 18, 1982

Related U.S. Application Data

[63] Continuation-in-part of Ser. No. 259,992, May 4, 1981, Pat. No. 4,364,534.

[51] Int. Cl.[3] ..... A63B 55/04

[52] U.S. Cl. ..... 248/97; 248/153

[58] Field of Search ..... 248/97, 95, 99, 100, 248/101, 153, 447; 232/43.2; 220/6

[56] References Cited

U.S. PATENT DOCUMENTS

| | | | |
|---|---|---|---|
| 1,006,328 | 10/1911 | Widenhofer | 248/175 |
| 3,056,524 | 10/1962 | Stoecker et al. | 220/6 |
| 3,370,787 | 2/1968 | Lindholm et al. | 248/99 |
| 3,638,888 | 2/1972 | Ross | 248/97 |
| 3,687,408 | 8/1972 | Lake | 248/97 |
| 3,826,455 | 7/1974 | O'Donnell | 248/97 |
| 3,917,103 | 11/1975 | Beretta | 220/6 |
| 4,299,365 | 11/1981 | Batle | 248/99 |
| 4,364,534 | 12/1982 | Valesko | 248/97 |
| 4,372,512 | 2/1983 | Wolfe | 248/97 |

FOREIGN PATENT DOCUMENTS

| | | | |
|---|---|---|---|
| 1444044 | 5/1966 | France | 248/447 |

*Primary Examiner*—William H. Schultz
*Assistant Examiner*—Ramon O. Ramirez
*Attorney, Agent, or Firm*—Stonebraker, Shepard & Stephens

[57] ABSTRACT

A wire bag stand 10 or 30 is made for resiliently gripping and holding the open mouth of a plastic bag. Stand 10 or 30 includes a base 11 and generally U-shaped sides 12 and 13 mounted on base 11 to splay upright above the base for supporting the bag. Base 11 provides stops against inward movement of the upright sides. Top spans 32 of the sides are bent outward to grip and engage a plastic bag, and the sides resiliently flex so that their tops can be sprung toward each other by a bag stretched and held between them.

16 Claims, 12 Drawing Figures

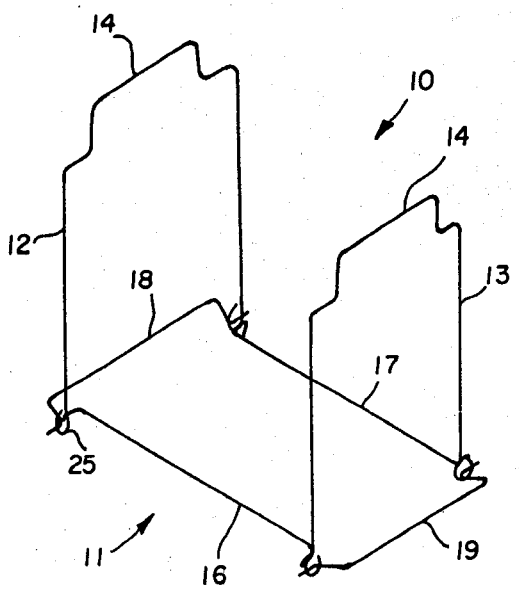
FIG. 1
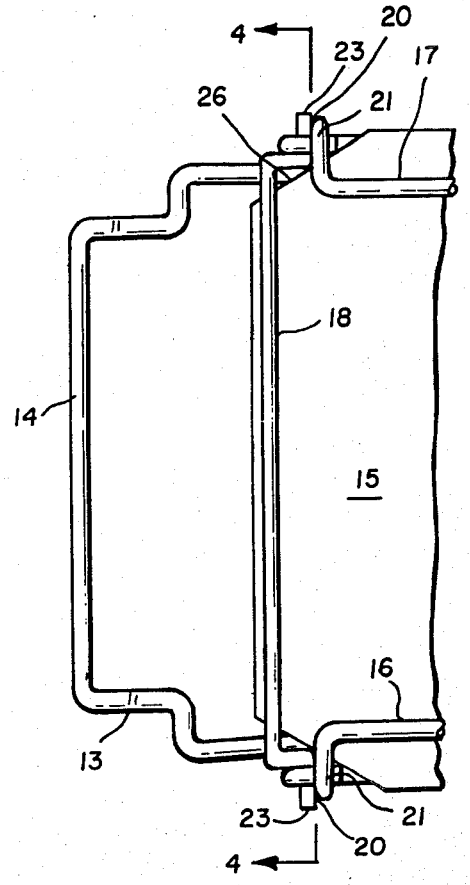
FIG. 3
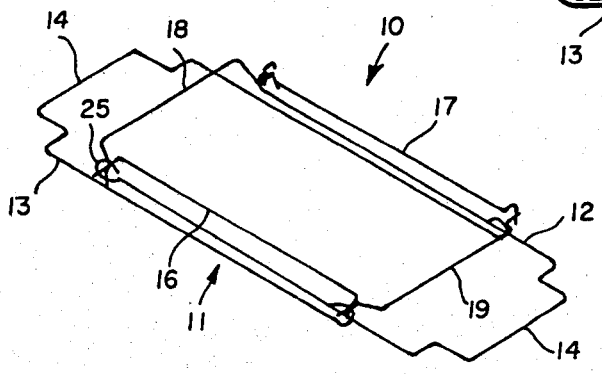
FIG. 2
FIG. 4
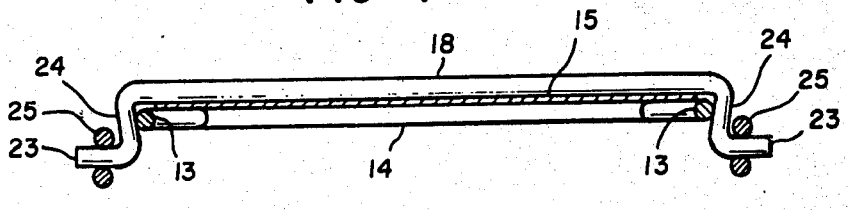

WIRE BAG STAND FOR HOLDING PLASTIC BAG

RELATED APPLICATIONS

This application is a Continuation-In-Part of my copending parent application Ser. No. 259,992, filed May 4, 1981, now U.S. Pat. No. 4,364,534 and entitled PLASTIC BAG STAND.

BACKGROUND

Plastic bags are being put to increasing uses around the home as containers for trash, garbage, lawn clippings, leaves, and other debris. Although plastic bags are good containers, they are limp and hard to manage; and several stands have been suggested for holding the open end of a plastic bag so that it can be easily filled. These stands suffer from being inconvenient, unreliable, expensive, and cumbersome. The bag stand suggested in my parent application overcomes many of these problems and combines low cost and simplicity with reliability and effectiveness.

I have now discovered that my bag stand can be adapted to hold all sorts of plastic bags. Different sizes of my stand can hold trash bags and grocery bags, for example.

SUMMARY OF THE INVENTION

I have found that the resilience of my wire bag stand can be used for reliably gripping and holding any suitably sized, open mouth plastic bag stretched between inwardly sprung top regions of the sides of the stand. Stops on the base hold the sides normally splayed from vertical. The sides, and preferably also the base, flex as the sides are drawn resiliently inward to receive a stretched open bag, and the stand resiliently grips and holds the bag in place with surprising effectiveness. The top regions of the sides of the stand are preferably bent outward to form a reliable grip on the open mouth of a bag wrapped over the bent out sides.

DRAWINGS

FIG. 1 is a perspective view of a preferred embodiment of the inventive bag stand with sides opened upright above the base to support a plastic bag;

FIG. 2 is a perspective view of the stand of FIG. 1 with the sides folded under the base for packaging and shipment;

FIG. 3 is a fragmentary plan view of the stand of FIGS. 1 and 2 in folded position holding a display card;

FIG. 4 is a cross-sectional view of the stand of FIG. 3 taken along the line 4—4 thereof;

DETAILED DESCRIPTION

Figure 5:
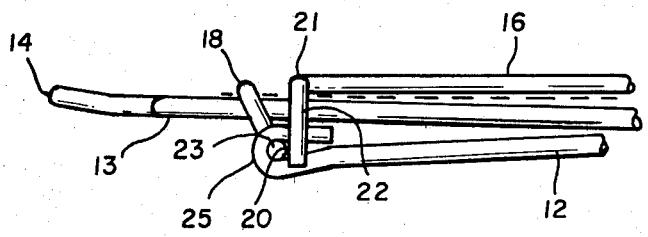
FIG. 5 is an enlarged fragmentary side elevational view of one corner of the stand in folded position.
Figure 6:
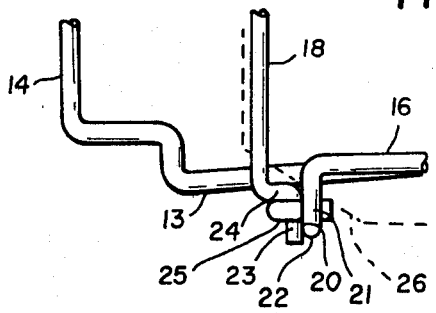
FIG. 6 is an enlarged fragmentary plan view of the corner of the stand shown in FIG. 5.

Bag stand 10 is formed of wire to include a base 11 and a pair of generally U-shaped sides 12 and 13 that are pivotally mounted to open upright above base 11 as shown in FIG. 1 and to fold flat under base 11 as shown in FIG. 2. The upper ends 14 of sides 12 and 13 engage the handles of a plastic bag (not shown) and support it in an open position above base 11 for receiving garbage or rubbish. Folding sides 12 and 13 under base 11 as shown in FIG. 2 makes stand 10 compact and nearly flat for packaging and shipment. The improvements in stand 10 involve the structure of base 11 and the mounting of sides 12 and 13 on base 11 as described below.

Base 11 is formed of a pair of opposed longitudinals 16 and 17 and a pair of opposed laterals 18 and 19 that are joined together in four bonds 20 preferably formed as spot welds. The central spans of longitudinals 16 and 17 and the mid-regions of laterals 18 and 19 all lie approximately in one plane and form a frame supporting one face of a display card 15. Longitudinals 16 and 17 and laterals 18 and 19 also form fixed pivots for sides 12 and 13, detents for both the folded and upright positions of the sides, and upright stops for the sides, besides forming a structurally rugged base 11.

The central spans of longitudinals 16 and 17 are spaced apart by less than the width of sides 12 and 13, and end portions of longitudinals 16 and 17 are bent outward at 21 and downward at 22 to join laterals 18 and 19 at bonds 20. Laterals 18 and 19 have end regions 23 joined to the down bends 22 longitudinals 16 and 17 at bonds 20, and end regions 23 also form pivot journals for the lower ends of sides 12 and 13. End regions 23 are parallel with and offset from mid-regions of laterals 18 and 19, and between the mid-regions and end regions of the laterals are S-curves 24 that accomplish detenting and help with card holding.

Figure 7:
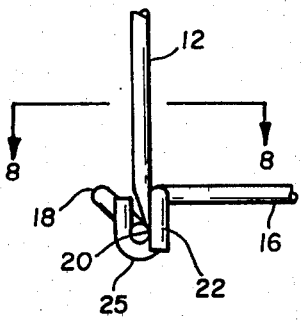
FIG. 7 is an enlarged fragmentary side elevational view of the corner of the stand shown in FIG. 5 with a side opened upright.
Figure 8:
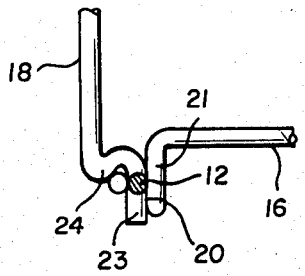
FIG. 8 is an enlarged cross-sectional view of the stand portion of FIG. 7 taken along the line 8—8 thereof.

Lower regions of sides 12 and 13 are bent into loops 25 that encircle journal ends 23 of laterals 18 and 19. This traps loops 25 between S-curves 24 and bonds 20 so that each loop 25 pivots in a fixed position on base 11. In a side upright position, each loop 25 detents against an outside surface of an S-curve 24 as best shown in FIGS. 7 and 8. The lower regions of sides 12 and 13 in the vicinity of loops 25 also bear against out bends 21 of longitudinals 16 and 17 for vertical stops that cooperate with the detenting of loops 25 against S-curves 24 to hold sides 12 and 13 in the upright position shown in FIG. 1.

When sides 12 and 13 are folded under base 11, they overlap and bend so their upper regions are detented against inside surfaces of S-curves 24 at opposite ends of base 11 as best shown in FIGS. 3–6. In this position, sides 12 and 13 retain card 15 in place by bearing against the card face opposite to the face engaging longitudinals and laterals 16–19. Card 15 also preferably has clipped corners 26 to engage in S-curves 24 and help hold card 15 within the frame of base 11.

The S-curves 24 of laterals 18 and 19 are preferably angled at about 45° to a plane through the central spans of longitudinals 16 and 17 and through the mid-regions of laterals 18 and 19. This positions S-curves 24 optimally for effective detenting of sides 12 and 13 in both open and folded positions. The lengths of laterals 18 and 19 and the widths of sides 12 and 13 can also be selected for effective detenting in both open and folded positions.

Spacing the central spans of longitudinals 16 and 17 inside the pivot points for loops 25 on lateral end regions 23 not only allows out bends 21 to serve as upright stops for sides 12 and 13, but also keeps loops 25 toward the outside corners of the framework of base 11 to prevent tearing or grabbing plastic bags during use. Arranging the mid-regions of laterals 18 and 19 in the plane of the central spans of longitudinals 16 and 17 not only provides a supporting frame for display card 15, but also forms a secure bottom support for a plastic bag.

Bag stand 30 as shown in FIGS. 9–12 can hold any open mouth plastic bag within a suitable size range. It uses the resilience of the stand in cooperation with the upper ends of the sides of the stand to grip, stretch, and securely retain the open mouth of a plastic bag. The structure of the base and pivoted sides of stand 30 is preferably similar to stand 10, and sides 12 and 13 of stand 30 also preferably fold under base 11 for storage.

Figure 9:
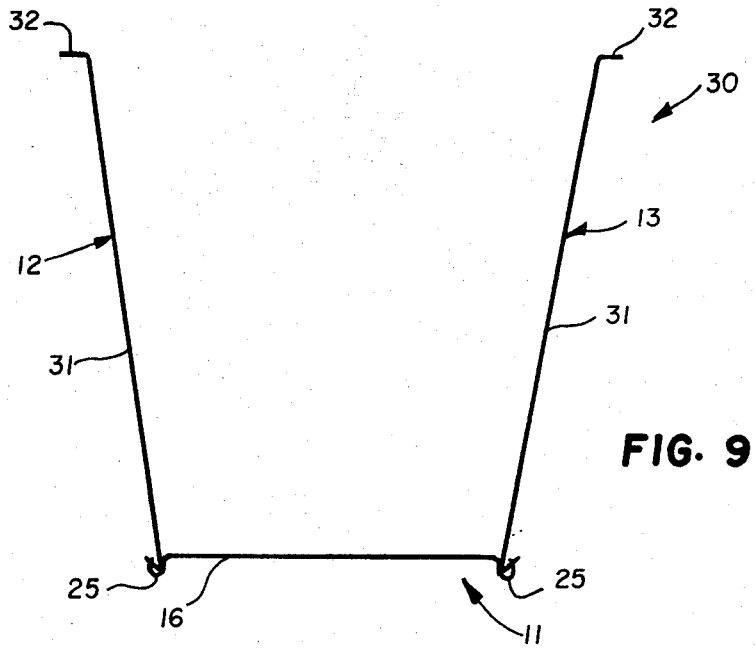
FIG. 9 is a partially schematic view of my bag stand with sides splayed upright above the base to receive a plastic bag.
Figure 11:
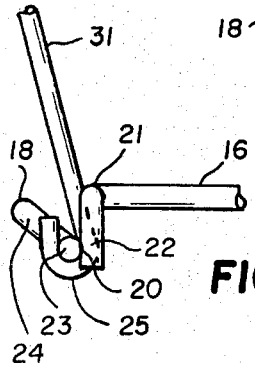
FIG. 11 is an enlarged fragmentary side elevational view of the lower left corner of the stand of FIG. 10.

As best shown in FIGS. 9 and 11, upright spans 31 of sides 12 and 13 are unbent where they extend upward from loops 25 so that they stop against outward bends 21 of longitudinal wires 16 and 17 in upright positions that are slightly splayed. This angles the sides a few degrees from vertical and spreads them farther apart than the width of a bag to be supported. Base 11 can be formed in other ways to provide mounts and stops for splaying sides 12 and 13.

Figure 12:
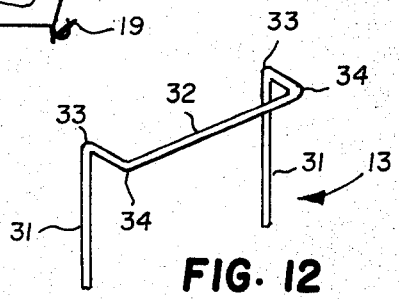
FIG. 12 is a fragmentary perspective view of the bent out upper end of the right side of the stand of FIGS. 9 and 10.

To help grip the open mouth of a plastic bag, the upper end regions of sides 12 and 13 preferably have bent out top spans 32 as best shown in FIGS. 9 and 12. The upper ends of sides 12 and 13 can be bent outward in several ways that are variously effective at gripping and holding a plastic bag, but the approximately 90° bends 33 in upright spans 31 near the tops of sides 12 and 13 are preferred for forming a pair of corners 34 over which a plastic bag is stretched and held. Other workable alternatives include bends 33 that are less than 90°, positioning bends 33 at different distances from top span 32, and curving top span 32. From experience so far, right angle corners 34 work best.

When sides 12 and 13 are folded under base 11 for storage, bent out tops 32 are disposed upward and have a depth that approximates the vertical depth of base 11. This helps keep the stand compact for both packaging and storage. A region of upright spans 31 below bends 33 detents against the S-curves 24 when folded under base 11 for packaging or storage.

When sides 12 and 13 are erected upright as shown in FIG. 9, they detent against S-curves 24 of laterals 18 and 19 and are held in an upright splayed position. To mount a bag on stand 30 then requires only that the open mouth of a bag 40 be folded or wrapped over a bent out top span 32 and drawn to and folded or wrapped over the opposite top span 32.

Figure 10:
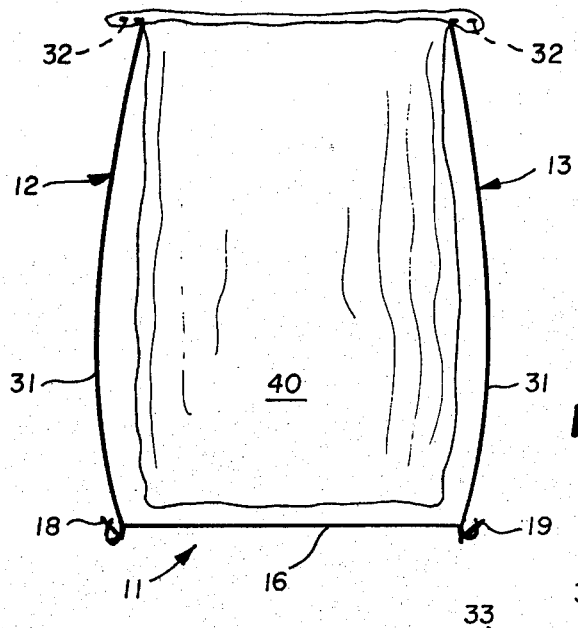
FIG. 10 is a partially schematic view of the bag stand of FIG. 9 with a plastic bag stretched over the upper ends of the sides of the bag stand and supported for filling.

This draws sides 12 and 13 inward as shown in FIG. 10 and springs them to an extent that depends on the dimensions of bag 40. Base longitudinals 16 and 17 also flex as illustrated in FIG. 10 when sides 12 and 13 are pulled inward against stops formed by outward spans 21 at the ends of longitudinals 16 and 17. Longitudinals 16 and 17 are spaced above loops 25 on which stand 30 rests to accommodate downward bending as sides 12 and 13 are drawn inward. So the base longitudinals 16 and 17 and the upright spans 31 of sides 12 and 13 all flex cooperatively in a resilience that pulls outward against the stretched open mouth of bag 40 so that bent out top spans 32 hold the bag securely in place. A non-resilient base 11 can also be used to support resilient sides 12 and 13 that are sprung inward by a stretched bag mouth and provide bag-holding bias. Experiments have shown that a bag supported on resilient stand 30 will tear before slipping from the grip that the stand applies to the bag.

Bag 40 can be released from stand 30 by merely unfolding its top from an upper end of one of the sides of the stand. Mounting and dismounting bag 40 requires only a second or so, once the motion is learned.

I claim:

1. A plastic bag stand comprising:

a. a base;

b. a pair of generally U-shaped wire sides mounted on said base to extend upright above said base in a bag-holding position;

c. top regions of said sides being bent outward to engage and hold an open mouth of a plastic bag;

d. said base having stop means engaging lower regions of said sides at predetermined angles to said base in said bag-holding position and preventing said lower regions of said sides from inclining toward each other at any angles less than said predetermined angles, which are selected for spacing said top regions of said sides apart by more than a bag-mounting distance; and e. upright spans of said sides being sufficiently resilient in the region between said stop means and said top regions so that said sides can be manually sprung toward each other to bring said top regions within said bag-mounting distance.

2. The stand of claim 1 wherein said outwardly bent top regions are formed by bends in said upright spans of said sides.

3. The stand of claim 2 wherein a top span of said sides extends between corners of said outwardly bent top regions for gripping and holding said plastic bag.

4. The stand of claim 1 wherein said base is formed of wire providing said stop means, and wires of said base extending between said sides flex as said sides are sprung toward each other.

5. The stand of claim 4 wherein said sides are pivotally mounted on said base to fold flat under said base for packaging and storage and to open upright against said stop means, and detent means support said sides in said upright positions against said stop means.

6. The stand of claim 5 wherein said base is formed of a pair of opposed longitudinal wires having central spans spaced apart by less than the width of said sides, end portions of said longitudinal wires are bent to form outward spans and downward spans, a pair of opposed lateral wires extend between said end portions of said longitudinal wires, end regions of said lateral wires are bent to form S-curves leading to end spans parallel with and offset from mid-regions from said lateral wires, bonds join said end spans of said lateral wires and said downward spans of said longitudinal wires, and said sides are pivotally mounted on said end spans of said lateral wires between and adjacent said S-curves and said bonds so that said outward spans of said longitudinal wires form said stop means limiting said upright positions of said sides.

7. The stand of claim 6 wherein lower regions of said sides detent against said S-curves in said upright positions against said stop means.

8. The stand of claim 7 wherein said outwardly bent top regions are formed by bends in said upright spans of said sides.

9. The stand of claim 8 wherein said upright spans of said sides below said outward bends against said S-curves when folded under said base for packaging and storage.

10. The stand of claim 1 wherein said predetermined angles are greater than 90°.

11. The stand of claim 10 wherein said base is formed of wire providing said stop means, and wires of said base extending between said sides flex as said sides are sprung toward each other.

12. The stand of claim 11 wherein said sides are pivotally mounted on said base to fold flat under said base for packaging and storage and to open upright against said stop means, and detent means support said sides in said upright positions against said stop means.

13. The stand of claim 12 wherein said base is formed of a pair of opposed longitudinal wires having central spans spaced apart by less than the width of said sides, end portions of said longitudinal wires are bent to form outward spans and downward spans, a pair of opposed lateral wires extend between said end portions of said longitudinal wires, end regions of said lateral wires are bent to form S-curves leading to end spans parallel with and offset from mid-regions from said lateral wires, bonds join said end spans of said lateral wires and said downward spans of said longitudinal wires, and said sides are pivotally mounted on said end spans of said lateral wires between and adjacent said S-curves and said bonds so that said outward spans of said longitudinal wires form said stop means limiting said upright positions of said sides.

14. The stand of claim 13 wherein lower regions of said sides detent against said S-curves in said upright positions against said stop means.

15. The stand of claim 14 wherein said outwardly bent top regions are formed by bends in said upright spans of said sides.

16. The stand of claim 15 wherein said upright spans of said sides below said outward bends detent against said S-curves when folded under said base for packaging and storage.

* * * * *